United States Patent [19]

Nobileau et al.

[11] 4,343,495

[45] Aug. 10, 1982

[54] CONDUCTOR TIEBACK CONNECTOR

[75] Inventors: Philippe C. Nobileau, London, England; Darrell L. Jones, Ventura, Calif.

[73] Assignee: Vetco Offshore, Inc., Ventura, Calif.

[21] Appl. No.: 120,200

[22] Filed: Feb. 11, 1980

[51] Int. Cl.[3] ..... F16L 55/00

[52] U.S. Cl. ..... 285/23; 285/24; 285/39; 285/370; 285/332.2

[58] Field of Search ..... 285/24, 27, 23, 39, 285/370, 18, 397, 231, 184, DIG. 21, 332.3, 332.2

[56] References Cited

U.S. PATENT DOCUMENTS

| | | | |
|---|---|---|---|
| 2,677,558 | 5/1954 | Cornelius | 285/27 X |
| 3,285,628 | 11/1966 | De Vries | 285/27 |
| 3,321,217 | 5/1967 | Ahlstone | 285/18 |
| 3,345,087 | 10/1967 | Hanes et al. | 285/39 |
| 3,368,832 | 2/1968 | Rader | 285/39 X |
| 3,455,578 | 7/1969 | Hanes | 285/18 |
| 3,675,713 | 7/1972 | Watkins | 285/18 |
| 4,033,613 | 7/1977 | Bram | 285/184 |
| 4,209,193 | 6/1980 | Ahlstone | 285/24 |

*Primary Examiner*—Dave W. Arola
*Attorney, Agent, or Firm*—Edward L. Kochey, Jr.

[57] ABSTRACT

A conductor tieback connector for connecting a conductor to a subsea wellhead includes a downwardly extending funnel. Two bearing rings within the funnel interact with the outside surface of the wellhead to generate bending forces to force the tool in alignment with the wellhead. Thereafter a separate lockdown nut secures the connector to the wellhead without rotation of the conductor.

4 Claims, 3 Drawing Figures

CONDUCTOR TIEBACK CONNECTOR

BACKGROUND OF THE INVENTION

The invention relates to offshore oil production apparatus and in particular to a connector for connecting a tieback conductor to a wellhead.

Offshore oil wells may be drilled from a floating platform and thereafter produced to a later constructed, fixed platform. Such a procedure requires the running of tieback conductors from the platform deck to the wellhead. Tubing is then run, surface production trees installed, and the wells produced in the conventional manner.

One conductor, and possibly other concentric conductors, is run to the wellhead from each platform. The largest or outermost conductor is connected and sealed to the wellhead. Horizontal offset may occur between the wellhead centerline and the corresponding platform well location. Angular misalignment between the wellhead and the guidance system of the conductor often occurs. Although the conductor string runs through guides located on the platform structure at various elevations, offset may occur as a result of inherent manufacturing and installation tolerances. Centralizers may be eccentrically located on the conductor to compensate for this misalignment.

The problem remains, however, of angular misalignment between the conductor and the wellhead as the conductor approaches the wellhead. Existing tieback tools cannot be engaged if the angular misalignment exceeds 0.5 degrees. Attempts to make up the joint may result in damage to the threads.

Seals are provided between the conductor connector and the wellhead. Rotation of the conductor for make up causes rubbing of the seal under compression with potential damage to the seal. Rotation of the string is cumbersome and does not allow the use of eccentric centralizers affixed to the conductor.

SUMMARY OF THE INVENTION

A conductor tieback connector for connecting a conductor to a subsea wellhead includes a tubular body which is connectable to the lower end of a conductor. A downwardly extending funnel is attached to the body and has two internal bearing surfaces, one located near the body and the other remote from the body. The funnel also includes a tapered guide at its lower end.

The tapered guide aids in initial stabbing of the connector over the wellhead, and the two bearing surfaces operate on the outside surface of the wellhead to force the conductor into angular alignment under the influence of the weight of the conductor. The internal diameter of the connector between the two bearing surfaces is greater than the diameter at each of the bearing surface locations with gradual slope in diameter occurring immediately below the upper bearing surface. Seals are located between the connector and the wellhead which are compressed with axial movement of the connector.

The bearing surfaces first act to bring the connector into accurate alignment with the wellhead. Thereafter, a lockdown means engages the wellhead and clamps the connector into precise alignment and compresses the seals. An internal floating bushing which is threadable with the interior surface of the wellhead permits this lockdown and clamping operation to the carried out without rotation of the conductor.

DESCRIPTION OF THE PREFERRED EMBODIMENT

Figure 1:
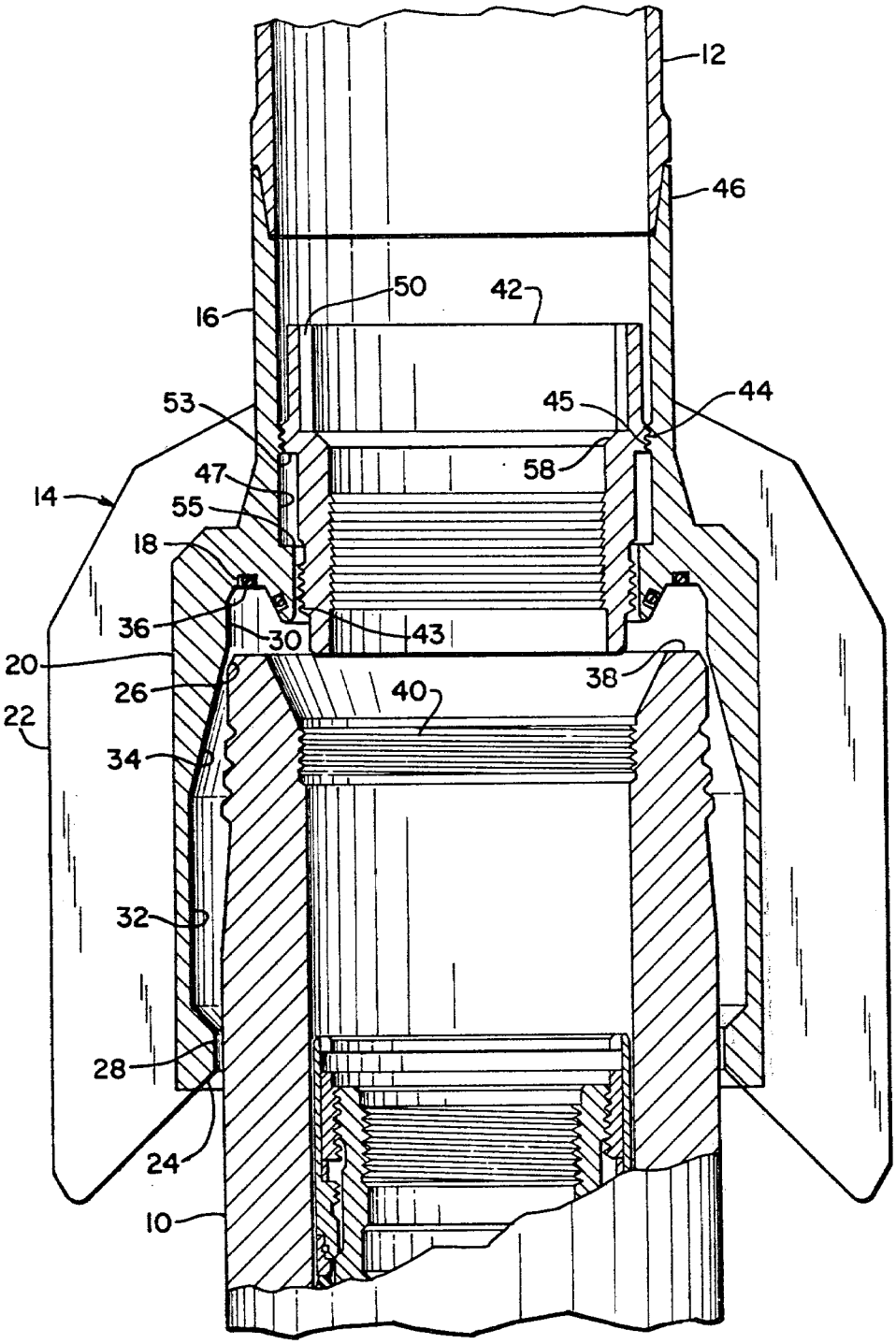
FIG. 1 illustrates the connector as it approaches the wellhead.
Figure 2:
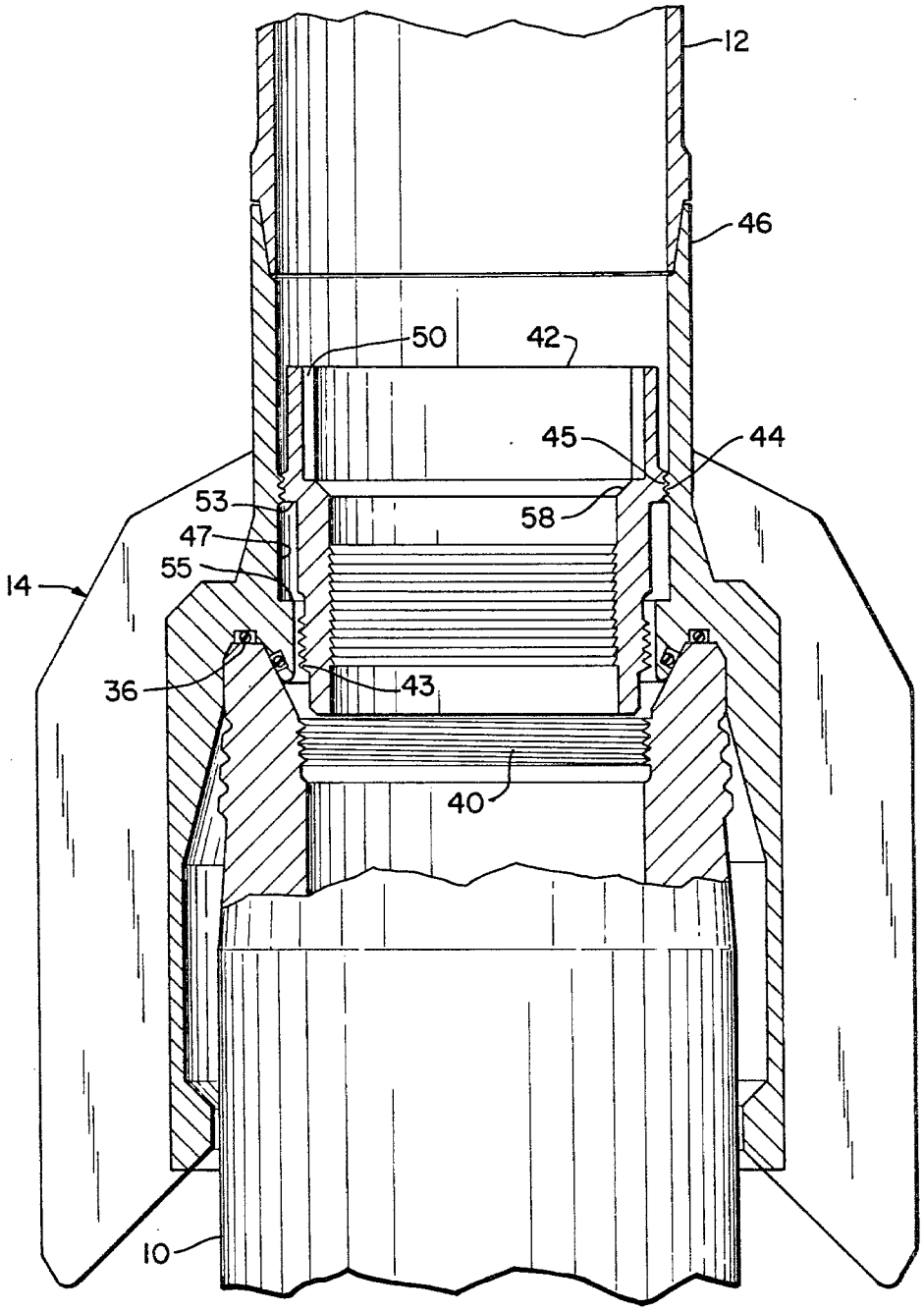
FIG. 2 illustrates the connector in the seated position.
Figure 3:
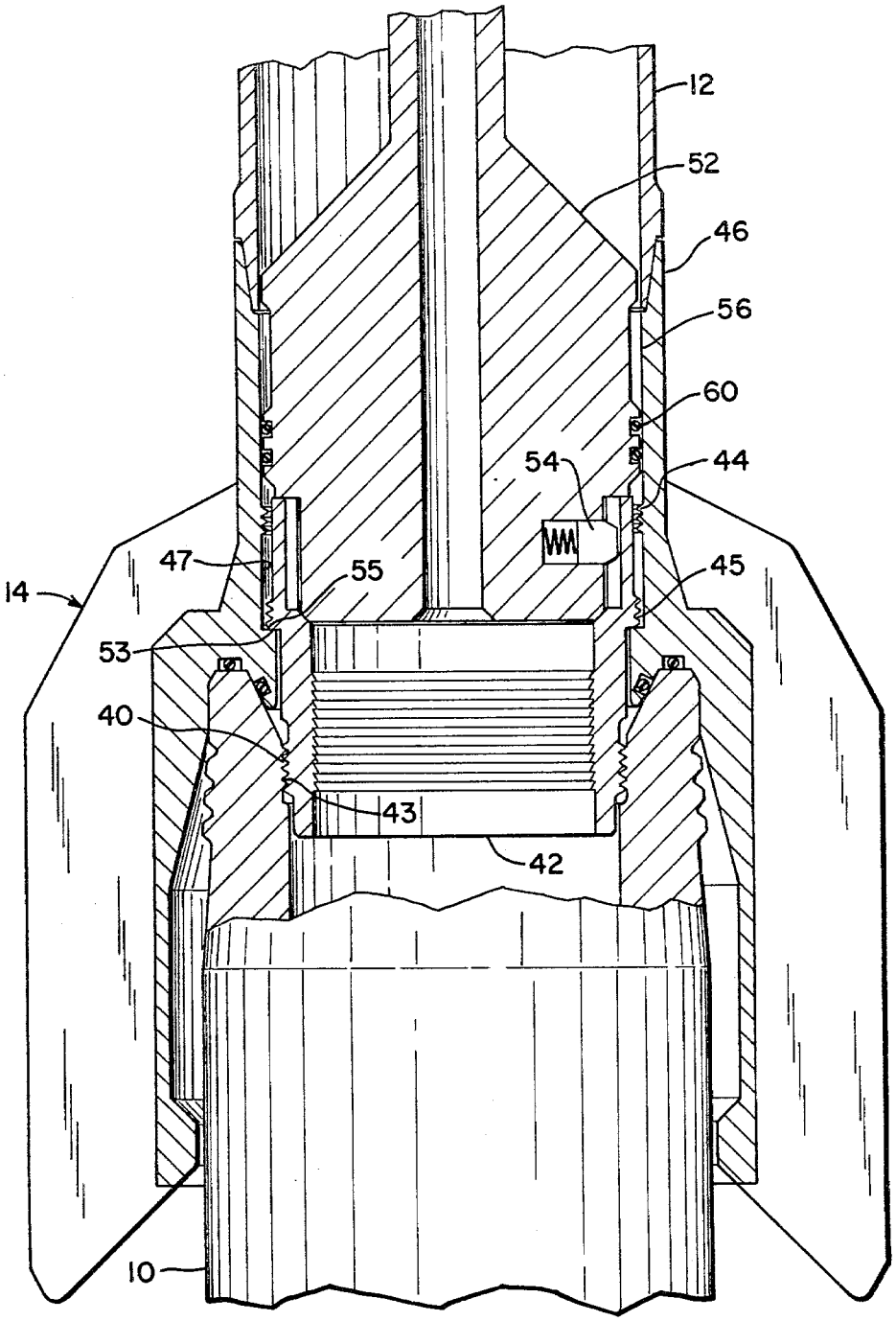
FIG. 3 illustrates the assembled connection as fully engaged.

A plurality of wells may be drilled from a floating platform while a fixed platform is being constructed. Each of the wells has a wellhead 10 located near the seabed. Once a well is drilled to depth, it is plugged, a protective cap installed, and the floating, drilling vessel moved to another well location preferably on a common drilling template.

Tieback of the subsea wells to the platform begins immediately after the platform installation is complete. The external conductor 12 is to be connected and sealed to the wellhead 10. The conductor tieback connector 14 is threadably connected and sealed to the conductor 12. This connector includes an upper tubular body 16 including seal grooves 18 at a location where seal rings may be contained for sealing with the wellhead 10.

The lower portion of the connector includes a funnel 20 which is securely attached to the tubular body and is a part of a single weldment. This funnel may include on its outer surface a plurality of guide ribs 22 which are tapered at the lower end faring uniformly into a tapered surface 24 at the lower end of the cylindrical funnel 20. If the connector approaches the wellhead with some horizontal offset, the lower edge of the guide ribs 22 interact with a tapered surface 26 at the upper edge of the wellhead. The weight of the conductor forcing the connector downwardly causes the conductor to deflect laterally and encircle the wellhead 10. The funnel includes a first and lower bearing surface 28 which has an internal diameter only slightly greater than the outside diameter of the wellhead. This provides accurate guidance of the lower end of the connector.

An upper bearing surface 30 also has a diameter only slightly greater than the outside diameter of the wellhead. The funnel at an intermediate location 32 between the first and second bearing surfaces has a diameter greater than that of either of the surfaces. The diameter gradually approaches that of the second bearing surface at the sloped internal diameter location 34.

As the connector is lowered with the first bearing surface 28 engaged, the internal surface 32 rides at the top of wellhead 22 followed by the sloped surface 34 and ultimatelythe upper bearing surface 30. Interaction between the two bearing surfaces and the outside surface of the wellhead applies a bending moment to force the conductor into alignment with the wellhead. The weight of the conductor applies the driving force, which may be augmented with a connector tool described hereinafter. Selection of tolerances between the various diameters should be such that this forces axial alignment within preferably 0.1 degrees.

At this time abutting surfaces of the wellhead and connector contact, and seals 36 located within grooves 18 are compressed against the upper surface 38 of the wellhead. Only the weight of the conductor string operates to compress the seal.

The interior surface of the wellhead 10 contains screw threads 40. A floating bushing 42 has lower external threads 43 adapted to mate with threads 40. The conductor connector 14 also includes upper internal threads 44, which mate with upper external threads 45 of the floating bushing 42.

These upper threads operate to support the bushing in a withdrawn and protected position during the running of the conductor. Prior to sealably connecting the connector 14 to the conductor 12 at joint 46, the bushing 42 is inserted from the top of the connector and rotated into engagement with threads 44. The inside diameter 47 of the connector below the threads 44 is greater than the outside diameter of threads 45, so that the bushing may be later rotated to pass through the threads.

The bushing includes vertical slots 50 which provide a means for interlocking the bushing with a rotating tool 52. This rotating tool includes spring activated latches 54 which engage the vertical slots. A tubing string, carrying tool 52 may be run down and the tool used to rotate the bushing thereby releasing the bushing from its upper position. The longitudinal spacing of the threaded sections is such that the bushing is released from engagement between threads 44 and 45 before threads 40 and 43 engage. This provides a floating position of the bushing which facilitates engagement of the lower threads. Further rotation of the bushing compresses the connector against the wellhead through the action of shoulders 53 and 55. The connector is thus brought into precise alignment, and the seals further compressed. This brings the connection into precise alignment through the interaction at slope 26 of the wellhead and further compresses the seals.

The conductor tieback connector also includes an internal land 56 which provides a sealing surface. When the torque tool is landed, it rests on shoulder 58 of the bushing. With the bushing in its supported position, the seal rings 60 of the torque tool are then at an elevation where they will seal against the land 56. Accordingly, a low pressure tightness test may be run before releasing and tightening the bushing, by attempting to pressurize the interior of the conductor.

If a seal has not been effected under the weight of the conductor, additional force may be applied using torque tool weight thru the bushing. Drill collars on the running string of the torque tool may be used for this purpose. After it is determined that the connector is properly sealed, the bushing is rotated free of threads 44 and torqued into threads 40, as described above.

The conductor tieback connector permits engagement between the conductor and the wellhead with some horizontal offset and with significant angular misalignments. The bearing surfaces of the funnel operate to generate a bending moment which brings the conductor into alignment with the wellhead and, accordingly, brings the threaded bushing into alignment, whereby the threaded connection may be safely made without cross threading or damaging of threads. The conductor connector is also adaptable to interact with the torque tool to permit a low pressure test of the conductor to verify full engagement of the connector over the wellhead prior to securing the connection with the floating bushing. Furthermore, the connection is made without any rotation of the conductor 12 and any rotational wear on seals 36.

We claim:

1. A conductor tieback connector for connecting a conductor to an internally threaded subsea wellhead comprising; a tubular body, sealably and rigidly connectable to the conductor; a downwardly extending funnel means for aligning the connector, rigidly connected to said tubular body, and having a first internal bearing surface remote from said tubular body and forming a diameter only slightly greater than the outside diameter of the wellhead, and a second internal bearing surface adjacent said tubular body forming a diameter only slightly greater than the outside diameter of said wellhead, said second surface vertically spaced from said first surface; abutting surfaces on the wellhead and said tubular body for abutting when said connector is fully engaged within the wellhead; lockdown means comprising, an externally threaded floating bushing located within said tubular body, a shoulder internal of said tubular body and having shoulder means thereon and engaging said shoulder means on said floating bushing for preventing downward movement of the bushing relative to said body, said bushing adapted to engage the internal threads of said wellhead and means for interlocking said bushing with a rotating tool, whereby rotation of said bushing locks said tubular body downwardly against said wellhead.

2. A connector as in claim 1: said tubular body having internal body threads extending inwardly beyond the internal surface of said body both above and below the threads; and external threads located on said bushing, of a maximum diameter not exceeding the internal diameter of the internal surface of said body above and below said internal body threads, and adapted to engage said internal body threads, whereby said bushing may selectively be supported on or rotated thru said body threads.

3. A connector as in claim 1 or 2 wherein said downwardly extending funnel means has an internal diameter between said first and second bearing surfaces greater than the inside diameter at each bearing surface, and wherein this inside diameter is gradually reduced to that of the second bearing surface immediately below said second bearing surface.

4. A connector as in claim 3 wherein seals are located at one of said abutting surfaces to be compressed by axial movement of the connector relative to the wellhead.

* * * * *